US008965253B2

(12) United States Patent
Kusukawa et al.

(10) Patent No.: US 8,965,253 B2
(45) Date of Patent: Feb. 24, 2015

(54) DEVELOPING DEVICE AND IMAGE FORMING APPARATUS INCLUDING THE SAME

(71) Applicant: KYOCERA Document Solutions Inc., Osaka (JP)

(72) Inventors: Takashi Kusukawa, Osaka (JP); Kenichi Mukai, Osaka (JP); Tomohiro Sue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 79 days.

(21) Appl. No.: 13/767,197

(22) Filed: Feb. 14, 2013

(65) Prior Publication Data

US 2013/0209142 A1 Aug. 15, 2013

(30) Foreign Application Priority Data

Feb. 14, 2012 (JP) ..... 2012-029035
Jul. 23, 2012 (JP) ..... 2012-162316

(51) Int. Cl.
*G03G 15/09* (2006.01)
*G03G 15/08* (2006.01)
*G03G 21/16* (2006.01)

(52) U.S. Cl.
CPC ..... *G03G 15/081* (2013.01); *G03G 15/0815* (2013.01); *G03G 21/1676* (2013.01)
USPC ..... 399/274; 399/284

(58) Field of Classification Search
USPC ..... 399/284, 274
See application file for complete search history.

(56) References Cited

U.S. PATENT DOCUMENTS

2008/0232860 A1* 9/2008 Sakata et al. ..... 399/270
2008/0232862 A1* 9/2008 Fujishima et al. ..... 399/285
2009/0285597 A1 11/2009 Uetake et al.
2010/0247164 A1 9/2010 Shigehiro
2011/0229184 A1 9/2011 Kashimoto et al.
2014/0140740 A1* 5/2014 Yamane et al. ..... 399/274

FOREIGN PATENT DOCUMENTS

EP 2 006 747 A1 12/2008
JP 09-211974 A 8/1997

(Continued)

OTHER PUBLICATIONS

English Abstract and Translation for JP 09-211974 A, published Aug. 15, 1997.
English Abstract and Machine Translation for JP 2008-037543 A, published Feb. 21, 2008.

(Continued)

*Primary Examiner* — G. M. Hyder
(74) *Attorney, Agent, or Firm* — NDQ&M Watchstone LLP

(57) ABSTRACT

A developing device includes: a developing roller; a toner supplying roller; a regulation blade; a casing; a film member; a bias member; and a protrusion. The casing includes an inner wall portion which opposes the developing roller between the blade roller and the image carrier. The film member is flexible, disposed to oppose an upper surface of the inner wall portion over a predetermined gap and vibratile in a direction to approach or leave the inner wall portion. The bias member is connected to at least one end in a longitudinal direction of the film member and gives tension to the film member. The protrusion is disposed on a gear composing a group of drive gears of the developing roller or the toner supplying roller and intermittently contacts an end edge of the film member thanks to rotation of the gear to vibrate the film member.

11 Claims, 9 Drawing Sheets

(56) References Cited

FOREIGN PATENT DOCUMENTS

| | | | | |
|---|---|---|---|---|
| JP | 2008-037543 | A | | 2/2008 |
| JP | 2008116481 | A | * | 5/2008 |
| JP | 2011-197285 | A | | 10/2011 |

OTHER PUBLICATIONS

Extended European Search Report from the European Patent Office dated Aug. 1, 2013 with respect to the corresponding EP application EP 13 15 4836.

* cited by examiner

DEVELOPING DEVICE AND IMAGE FORMING APPARATUS INCLUDING THE SAME

INCORPORATION BY REFERENCE

This application is based on and claims the benefit of priority from Japanese Patent Application No. 2012-29035 filed on Feb. 14, 2012 and No. 2012-162316 filed on Jul. 23, 2012, the contents of which are hereby incorporated by reference.

BACKGROUND

The present disclosure relates to a developing device for supplying a developer to an image carrier and an electro-photographic image forming apparatus including the developing device.

In an image forming apparatus of the electro-photographic type, an electrostatic latent image is formed by directing light to a circumferential surface of an image carrier (photosensitive drum) based on image information read from a document image or on image information transmitted from external devices such as a computer and the like, and a toner image is formed by supplying toners from a developing device to the electrostatic latent image, thereafter, the toner image is transferred onto a paper sheet. The paper sheet after the transfer process undergoes a toner-image fixing process, and then is ejected to outside.

And, as the developing method that uses dry toners in an image forming apparatus that uses an electro-photographic process, a developing method is proposed, in which when moving a developer, by using a magnetic roller (toner supplying roller), onto a developing roller disposed not to contact a photoreceptor (image carrier), only non-magnetic toners are transferred onto the developing roller to form a toner thin layer with the magnetic carriers left on the magnetic roller; and toners are made to adhere to an electrostatic latent image on the photoreceptor by using an a.c. electric field at an opposing region (developing region) between the developing roller and the photoreceptor.

In the meantime, in recent years, in an image forming apparatus, because of a transition to color printing and high speed processing, an apparatus structure is becoming complicated, and in order to be compatible with the high speed processing, it is inevitable to rotate a toner stir member in a developing device at a high speed in particular, in the above developing method that uses a two-component developer containing magnetic carriers and toners, a magnetic roller for carrying the developer and a developing roller for carrying the toners only, at an opposing portion between the developing roller and the magnetic roller, only the toners are carried onto the developing roller by a magnetic brush formed on the magnetic roller, and further, toners that are left unused for the developing are peeled off the developing roller. Accordingly, floating toners are liable to occur near the opposing portion between the developing roller and the magnetic roller, and if the floating toners accumulate around a bristle cut blade (regulation blade) and the accumulating toners aggregate and adhere to the developing roller, there is a risk that toner dropping could occur and cause an image defect.

To solve the above problems, a developing device is known, which at a wall portion that opposes a developing roller between a regulation blade and a developing region, includes: a flexible sheet member that composes a portion of an inner wall surface of the wall portion and is vibratile in a direction perpendicular to the inner wall surface; and an ellipsoidal roller that moves the sheet member.

Besides, a developing device is known, which includes a vibration mechanism that gives an acceleration in a direction in which toners adhering to a vessel wall of the developing device are made to fall into the vessel.

In the developing device that includes the flexible sheet member and the ellipsoidal roller that moves the sheet member, the sheet member is moved by using rotation of the ellipsoidal roller, whereby the toners accumulating on the sheet member are shaken off. Besides, in the developing device which includes the vibration mechanism that gives an acceleration to the vessel wall of the developing device, the developing device itself is vibrated by the vibration mechanism, whereby the toners adhering to the developer vessel are shaken off. However, the structure which moves the flexible sheet member by using the ellipsoidal roller additionally needs a motor for rotating the ellipsoidal roller; and also the structure which moves the developer vessel itself by using the vibration mechanism additionally needs a lever and an actuator, an electromagnetic solenoid and the like which compose the vibration mechanism, accordingly, there are problems that the cost of the developing devices increases and the structures become complicated.

SUMMARY

It is an object of the present disclosure to provide a developing device capable of effectively alleviating toner accumulation near a regulation blade in a casing and an image forming apparatus that includes the developing device.

A developing device according to an aspect of the present disclosure includes: a developing roller; a toner supplying roller; a regulation blade; a casing; a film member; a bias member; and a protrusion. The developing roller is disposed to oppose an image carrier on which an electrostatic latent image is formed and supplies a developer to the image carrier at a region that opposes the image carrier. The toner supplying roller is disposed to oppose the developing roller and supplies a toner to the developing roller at a region that opposes the developing roller. The regulation blade is disposed to oppose the toner supplying roller over a predetermined gap. The casing houses the developing roller, the toner supplying roller and the regulation blade and includes an inner wall portion which opposes the developing roller between the regulation blade and the image carrier. The film member is formed of a flexible material, disposed to oppose an upper surface of the inner wall portion over a predetermined gap and vibratable in a direction to approach or leave the inner wall portion. The bias member is connected to at least one end in a longitudinal direction of the film member and gives tension to the film member. The protrusion is disposed on a gear composing a group of drive gears of the developing roller or the toner supplying roller and intermittently contacts an end edge of the film member because of rotation of the gear to vibrate the film member.

Still other objects of the present disclosure and specific advantages obtained by the present invention will become more apparent from the following embodiments described hereinafter.

DETAILED DESCRIPTION

Figure 1:
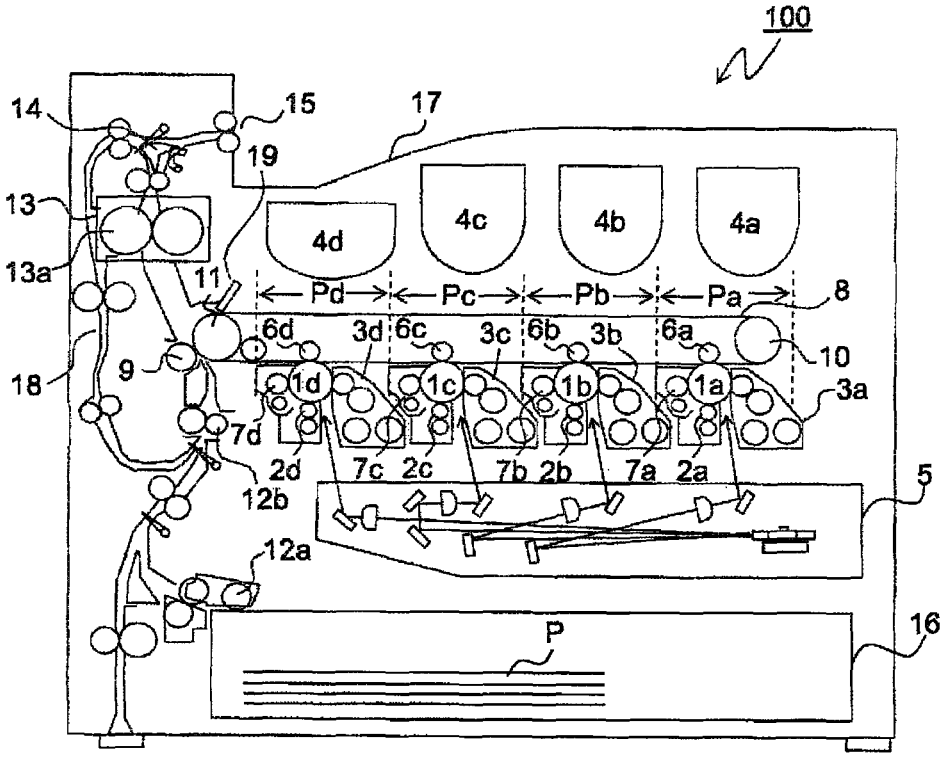
FIG. 1 is a schematic structural view of a color printer 100 that includes developing devices 3*a* to 3*d* according to the present disclosure.

Hereinafter, embodiments of the present disclosure are described with reference to the drawings. FIG. 1 is a schematic sectional view of a color printer 100 in which developing devices 3*a* to 3*d* of the present disclosure are disposed, and here shows a tandem-type color printer. In a main body of the color printer 100, four image forming portions Pa, Pb, Pc, and Pd are disposed in this order from an upstream side in a convey direction (right side in FIG. 1). These image forming portions Pa to Pd are disposed to correspond to images of four different colors (cyan, magenta, yellow, and black), and respectively form the images of cyan, magenta, yellow, and black sequentially by the steps for electrifying, exposing, developing, and transferring.

In the image forming portions Pa to Pd, there are respectively disposed photosensitive drums 1*a*, 1*b*, 1*e*, and 1*d* for carrying visible images (toner images) of respective colors, and an intermediate transfer belt 8 rotated by a drive means (not shown) in a clockwise direction in FIG. 1 is disposed adjacently to each of the image forming portions Pa to Pd. Toner images formed on these photosensitive drums 1*a* to 1*d* are sequentially primarily transferred onto the intermediate transfer belt 8, which moves contacting each of the photosensitive drums 1*a* to 1*d*, and superimposed on one another. Thereafter, the toner images primarily transferred onto the intermediate transfer belt 8 are secondarily transferred, because of operation of a secondary transfer roller 9, onto a transfer paper sheet P that is an example of a recording medium. Further, the toner images secondarily transferred onto the transfer paper sheet P are fixed at a fix portion 13, and are then ejected from the main body of the color printer 100. The photosensitive drums 1*a* to 1*d* are rotated in a counterclockwise direction in FIG. 1, and the image forming process is applied to each of the photosensitive drums 1*a* to 1*d*.

The transfer paper sheet P onto which the toner images are to be secondarily transferred is stored in a paper sheet cassette 16 that is disposed in a lower portion of the main body of the color printer 100. The transfer paper sheet P in the paper sheet cassette 16 is conveyed to a nip portion formed between the secondary transfer roller 9 and a drive roller 11 for the intermediate transfer belt 8 described later via a sheet feeding roller 12*a* and a registration roller pair 12*b*. For the intermediate transfer belt 8, a dielectric resin sheet, that is, a (seamless) belt having no seam mainly used. Besides, a blade-shaped belt cleaner 19 for removing toners and the like remaining on a surface of the intermediate transfer belt 8 is disposed on a downstream side with respect to the secondary transfer roller 9.

Next, the image forming portions Pa to Pd are described. Around and below the rotatably disposed photosensitive drums 1*a* to 1*d*, there are provided: electrification devices 2*a*, 2*b*, 2*c*, and 2*d* for electrifying the photosensitive drums 1*a* to 1*d*, respectively; an exposure device 5 for directing light to each of the photosensitive drums 1*a* to 1*d*; developing devices 3*a*, 3*b*, 3*c*, and 3*d* for forming a toner image on the photosensitive drums 1*a* to 1*d*, respectively; and cleaning portions 7*a*, 7*b*, 7*c*, and 7*d* for removing developer (toner) and the like remaining on the photosensitive drums 1*a* to 1*d*, respectively.

When image data are input from an upward apparatus such as a personal computer or the like, first, the electrification devices 2*a* to 2*d* evenly electrify surfaces of the photosensitive drums 1*a* to 1*d*. Next, the exposure device 5 directs light in accordance with the image data to form an electrostatic latent image corresponding to the image data on each of the photosensitive drums 1*a* to 1*d*. The developing devices 3*a* to 3*d* are each filled with a predetermined amount of two-component developer containing toners for the respective colors, that is, cyan, magenta, yellow, and black. Here, in a case where the percentage of the toners in the two-component developer loaded in the respective developing devices 3*a* to 3*d* becomes lower than a predetermined value because of the forming of toner images described below, the respective developing devices 3*a* to 3*d* are supplied with toners from toner containers (supply means) 4*a* to 4*d*. The toners in the developer is supplied onto the photosensitive drums 1*a* to 1*d* by the developing devices 3*a* to 3*d*, and the toners electrostatically adhere to the respective photosensitive drums 1*a* to 1*d*, whereby toner images, which correspond to the electrostatic latent images formed by the exposure performed by the exposure device 5, are formed.

And, by primary transfer rollers 6*a* to 6*d*, an electric field having a predetermined transfer voltage is given between the primary transfer rollers 6*a* to 6*d* and the photosensitive drums 1*a* to 1*d*, and the toner images of cyan, magenta, yellow, and black on the photosensitive drums 1*a* to 1*d* are primarily transferred onto the intermediate transfer belt 8. The toner images of four colors are formed to have a predetermined positional relationship that is predetermined for forming a predetermined full-color image. Thereafter, in preparation for the forming of new electrostatic latent images to be subsequently performed, the toners and the like remaining on the surfaces of the photosensitive drums 1*a* to 1*d* after the primary transfer are removed by the cleaning portions 7*a* to 7*d*, respectively.

The intermediate transfer belt 8 is mounted on a driven roller 10 on an upstream side and the drive roller 11 on a downstream side. When the intermediate transfer belt 8 starts to rotate in the clockwise direction in accordance with rotation of the drive roller 11 caused by a drive motor (not shown), the transfer paper sheet P is conveyed from the pair of registration rollers 12*b* at a predetermined timing to the nip portion (secondary transfer nip portion) between the drive roller 11 and the secondary transfer roller 9 disposed adjacently to the drive roller 11, and a full-color toner image on the intermediate transfer belt 8 is secondarily transferred onto the transfer paper sheet P. The transfer paper sheet P on which the toner image is secondarily transferred is conveyed to the fix portion 13.

The transfer paper sheet P conveyed to the fix portion 13 is heated and pressurized by a pair of fix rollers 13*a*, and the toner images are fixed onto the surface of the transfer paper sheet P to form the predetermined full-color image. The transfer paper sheet P on which the fall-color image is formed is switched in direction by a branch portion 14 that branches off into a plurality of directions. In a case where an image is formed on only one surface of the transfer paper sheet P, the transfer paper sheet P is ejected as it is to an ejection tray 17 by ejection rollers 15.

On the other hand, in a case where images are formed on both surfaces of the transfer paper sheet P, the transfer paper sheet P that passes through the fix portion 13 is temporarily conveyed toward the ejection roller 15. And, after a rear end of the transfer paper sheet P passes through the branch portion 14, the ejection roller 15 is rotated reversely, and the convey direction of the branch portion 14 is switched. According to this, the transfer paper sheet P is directed to a sheet transport path 18 with the rear end being conveyed ahead, and is again conveyed to the secondary transfer nip portion under a state where the image surface is reversed. And, the next toner image formed on the intermediate transfer belt 8 is secondarily transferred by the secondary transfer roller 9 onto a surface of the transfer paper sheet P on which no image is formed. The transfer paper sheet P on which the toner image is secondarily transferred is conveyed to the fix portion 31*a*, where the toner image is fixed, thereafter, ejected to the ejection tray 17.

Figure 2:
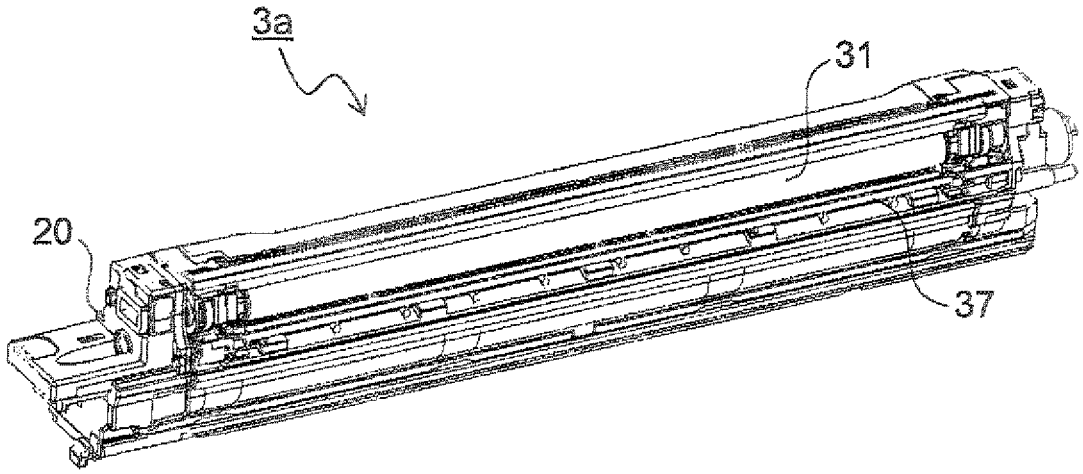
FIG. 2 is a perspective view of the developing device 3*a* according to a first embodiment of the present disclosure.
Figure 3:
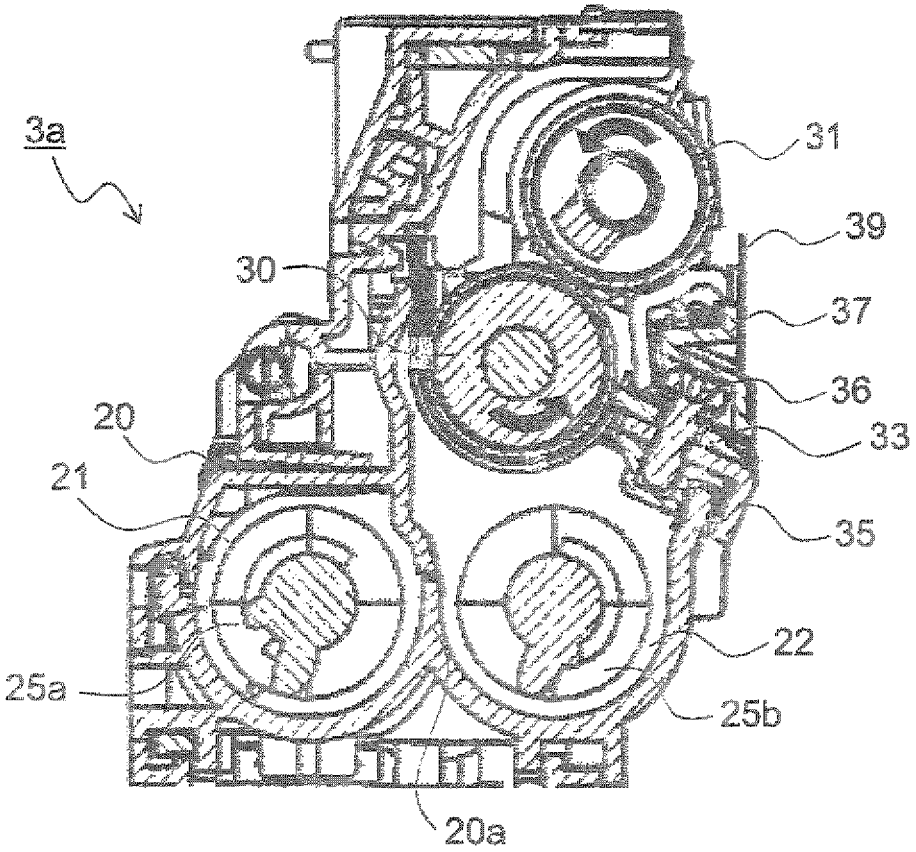
FIG. 3 is a side sectional view of the developing device 3*a* according to the first embodiment.

FIG. 2 is an outside appearance perspective view of the developing device 3*a* according to a first embodiment of the present disclosure, and FIG. 3 is a schematic side sectional view of the developing device 3*a* according to the first embodiment. Here, FIG. 3 shows a state when viewing the developing device 3*a* from a rear side of FIG. 1, and the disposition of each component in the developing device 3*a* is in a reverse relationship with FIG. 1 in left-right side. Besides, in the following description, the developing device 3*a* disposed at the image forming section Pa of FIG. 1 is described as an example, however, the structures of the developing devices 3*b* to 3*d* disposed at the image forming portions Pb to Pd are basically the same, accordingly, description is skipped. Besides, in the following description, a forward side of the main body of the color printer 100 is called a front side, and a backward side of the main body of the color printer 100 is called a rear side. For example, in FIG. 2, the left end of the developing device 3*a* is the front side and the right end of the developing device 3*a* is the rear side.

As shown in FIG. 2 and FIG. 3, the developing device 3*a* includes a developer vessel (easing) 20 for storing the two-component developer (hereinafter, simply called a developer), and the developer vessel 20 is partitioned by a partition wall 20*a* into a stir-convey chamber 21 and a supply-convey chamber 22. In the stir-convey chamber 21 and the supply-convey chamber 22, a stir-convey screw 25*a* and a supply-convey screw 25*b* for mixing toners (positively electrified toners) supplied from the toner container 4*a* (see FIG. 1) with carriers, stirring and electrifying them are each disposed rotatably.

And, the developer is stirred and conveyed in an axial direction (direction perpendicular to the paper surface of FIG. 3) by the stir-convey screw 25*a* and the supply-convey screw 25*b*, and circulates in the stir-convey chamber 21 and the supply-convey chamber 22 via not-shown developer paths formed at both end portions of the partition wall 20*a*. In other words, a developer circulation route is formed of the stir-convey chamber 21, the supply-convey chamber 22, and the developer paths in the developer vessel 20.

The developer vessel 20 extends toward upper right in FIG. 3, and in the developer vessel 20, a toner supplying roller 30 is disposed above the supply-convey screw 25*b*, and a developing roller 31 is disposed at upper right above the toner supplying roller 30 to oppose the toner supplying roller 30. The developing roller 31 opposes the photosensitive drum 1*a* (see FIG. 1) on an opening side (right side of FIG. 3) of the developer vessel 20. The toner supplying roller 30 and the developing roller 31 are each rotated in the counterclockwise direction in FIG. 3 about respective rotary shafts.

In the stir-convey chamber 21, a not-shown toner concentration sensor is disposed to oppose the stir-convey screw 25*a*, and based on a detection result from the toner concentration sensor, toners are supplied from the toner container 4*a* to the stir-convey chamber 21 via a not-shown toner supply opening. As the toner concentration sensor, for example, there is used a magnetic permeability sensor for detecting a magnetic permeability of the two-component developer containing the toners and magnetic carriers in the developer vessel 20.

The toner supplying roller 30 is a magnetic roller that is composed of a non-magnetic rotary sleeve which rotates in the counterclockwise direction in FIG. 3; and a stationary magnet body that has a plurality of magnetic poles enclosed in the rotary sleeve.

The developing roller 31 is composed of: a cylindrical developing sleeve that rotates in the counterclockwise direction in FIG. 3; and a developing roller-side magnetic pole secured in the developing sleeve. The toner supplying roller 30 and the developing roller 31 oppose each other over a predetermined gap at a facing position (opposing position). The developing roller-side magnetic pole has a polarity reverse to the polarity of the magnetic pole (main pole) of the stationary magnet body.

Besides, the developer vessel 20 is provided with a bristle cut blade (regulation blade) 33 disposed along a longitudinal direction (direction perpendicular to the paper surface of FIG. 3) of the toner supplying roller 30. The bristle cut blade 33 is fastened and secured to a blade support stay 35 disposed on the developer vessel 20 by using a blade fastener screw 36, and in the rotational direction (counterclockwise direction in FIG. 3) of the toner supplying roller 30, the bristle cut blade 33 is positioned on a more upstream side than the opposing position of the developing roller 31 and the toner supplying roller 30. And, a slight gap is formed between a tip end portion of the bristle cut blade 33 and a surface of the toner supplying roller 30.

A direct-current voltage (hereinafter, called Vslv (DC)) and an alternating-current voltage (hereinafter, called Vslv (AC)) are applied to the developing roller 31. A direct-current voltage (hereinafter, called Vmag (DC)) and an alternating-current voltage (hereinafter, called Vmag (AC)) are applied to the toner supplying roller 30. These direct-current voltages and alternating-current voltages are applied to the developing roller 31 and the toner supplying roller 30 from a developing bias power supply via a bias control circuit (none of which are shown).

As described above, the developer is stirred by the stir-convey screw 25*a* and the supply-convey screw 25*b* and circulates in the stir-convey chamber 21 and the supply-convey chamber 22 in the developer vessel 20, whereby the toners in the developer are electrified. The developer in the supply-convey chamber 22 is conveyed to the toner supplying roller 30 by the supply-convey screw 25*b*. And, a magnetic brush (not shown) is formed on the toner supplying roller 30. The magnetic brush on the toner supplying roller 30 is regulated in layer thickness by the bristle cut blade 33, thereafter, conveyed, by rotation of the toner supplying roller 30, to the opposing region of the toner supplying roller 30 and the developing roller 31. And, a toner thin layer is formed on the developing roller 31 by using: a potential difference ΔV between Vmag (DC) applied to the toner supplying roller 30 and Vslv (DC) applied to the developing roller 31; and a magnetic field.

The toner layer thickness on the developing roller 31 changes depending on resistance of the developer, a rotational speed difference between the toner supplying roller 30 and the developing roller 31 and the like, however, is controllable by using ΔV. The toner layer thickness on the developing roller 31 increases when increasing ΔV, and decreases when decreasing ΔV. As the range of ΔV during the developing time, 100 V to about 350 V is generally suitable.

The toner thin layer formed on the developing roller 31 because of contact with the magnetic brush on the toner supplying roller 30 is conveyed to the opposing region of the photosensitive drum 1*a* and the developing roller 31 because of the rotation of the developing roller 31. Vslv (DC) and Vslv (AC) are applied to the developing roller 31, accordingly, the toners fly from the developing roller 31 to the photosensitive drum 1*a* because of a potential difference between the developing roller 31 and the photosensitive drum 1*a*, whereby the electrostatic latent image on the photosensitive drum 1*a* is developed.

Toners remaining without being used for the developing are conveyed again to the opposing portion of the developing roller 31 and the toner supplying roller 30, and collected by the magnetic brush on the toner supplying roller 30. Next, the magnetic brush is peeled off the toner supplying roller 30 at the same polarity portion of the stationary magnet body, thereafter, fall into the supply-convey chamber 22.

Thereafter, based on the detection result from the toner concentration sensor (not shown), a predetermined amount of toners are supplied from the toner supply opening (not shown) into the developer vessel 20, and become the two-component developer that is evenly electrified again at a suitable toner concentration during the circulation in the supply-convey chamber 22 and the stir-convey chamber 21. The developer is supplied again onto the toner supplying roller 30 by the supply-convey screw 25*b*, whereby a magnetic brush is formed and conveyed to the bristle cut blade 33.

On a right-side wall of the developer vessel 20 in FIG. 3, a sleeve cover 37 having a substantially V shape in section is disposed near the developer roller 31 to protrude to an inside of the developer vessel 20. As shown in FIG. 3, the sleeve cover 37 is disposed along a longitudinal direction (direction perpendicular to the paper surface of FIG. 3) of the developer vessel 20, and an upper surface 37*a* (see FIG. 4) of the sleeve cover 37 composes an inner wall portion that opposes the developing roller 31 in the developer vessel 20.

A film-shaped seal member 39 is disposed at an upper end of the sleeve cover 37. The seal member 39 extends in a longitudinal direction (direction perpendicular to the paper surface of FIG. 3) of the sleeve cover 37 such that a tip end portion contacts the surface of the photosensitive drum 1*a* (see FIG. 1), and has a function to block the toners in the developer vessel 20 such that the toners do not leak to outside.

Figure 4:
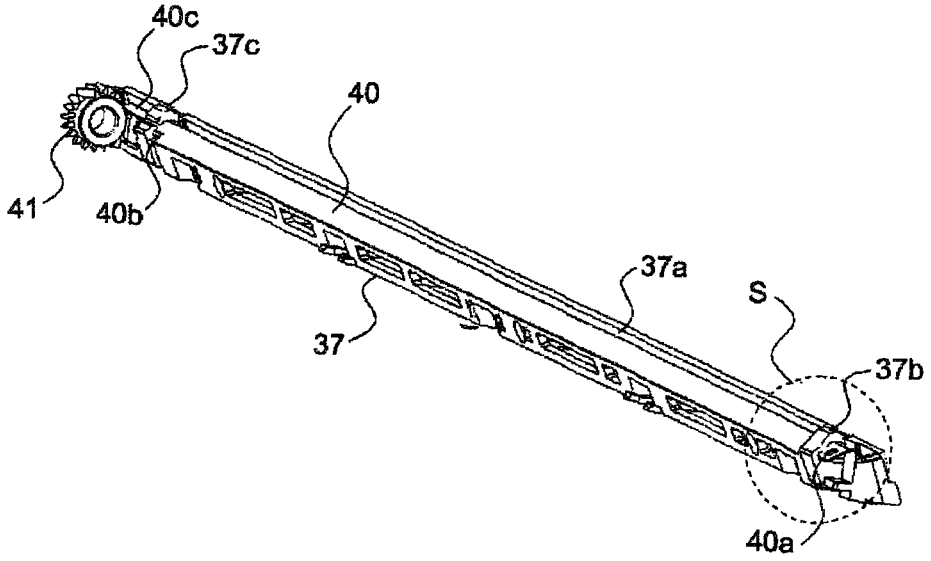
FIG. 4 is a perspective view when viewing, from inside of a developer vessel 20, a sleeve cover 37 used in the developing device 3*a* according to the first embodiment.
Figure 5:
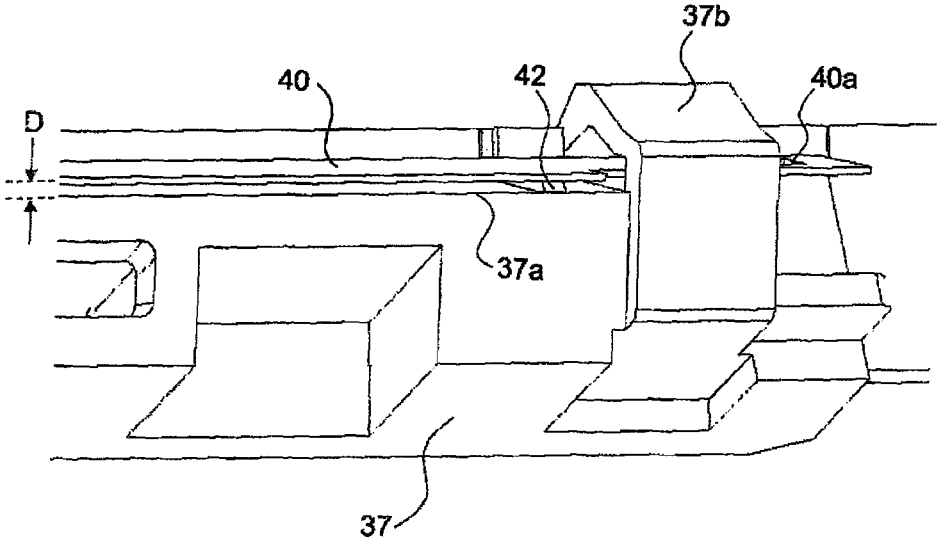
FIG. 5 is an enlarged perspective view of a portion near a front-side end portion of the sleeve cover 37 that is used in the developing device 3*a* according to the first embodiment.

FIG. 4 is a perspective view when viewing the sleeve cover 37 from the inside (left side of FIG. 3) of the developer vessel 20, and FIG. 5 is an enlarged perspective view of a portion (portion within a broken line circle S of FIG. 4) near a front-side end portion of the sleeve cover 37.

A film member 40 is supported on the upper surface 37*a* of the sleeve cover 37 along the longitudinal direction. The film member 40 is formed of a resin flexible material such as a PET film and the like and, as shown in FIG. 4, disposed on the substantially entire region of the upper surface 37*a* of the sleeve cover 37. It is preferable that the film member 40 is formed to be more unlikely to attract toners than the sleeve cover 37 by using a fluororesin film and the like as the material of the film member 40 or coating the film member 40 with a fluororesin. Besides, the film member 40 is vibrated with tension applied as described later, accordingly, some restoration force (resiliency) becomes necessary.

Guide portions 37*b*, 37*c*, into which end portions of the film member 40 are inserted, are formed at end portions of the front side (right side of FIG. 4) and rear side (left side of FIG. 4) of the upper surface 37*a* of the sleeve cover 37. A bias member is connected to at least one end in a longitudinal direction of the film member 40 and gives tension to the film member 40. In an embodiment, an end portion of the front side of the film member 40 is provided with an engagement hole 40*a* with which one end of a coil spring 43 (see FIG. 6) is engaged. Besides, a side end edge of the rear side of the film member 40 is provided with a rectangle-shaped cutout portion 40*b* at a position that opposes the guide portion 37*c*.

And the end portion of the rear side of the film member 40 passes through the guide portion 37*c* and extends to a more rear side portion to define a protrusion piece 40*c* that leads to a portion near an idle gear 41 that is connected to a drive input gear (not shown) of the toner supplying roller 30 and to a drive input gear 45 (see FIG. 7) of the developing roller 31.

Besides, as shown in FIG. 5, the upper surface 37*a* of the sleeve cover 37 is provided with a rib 42 near the front-side guide portion 37*b*. Meanwhile, not shown here though, the rib 42 having the same height is also disposed near the rear-side guide portion 37*c*. According to this, the film member 40 is supported away from the upper surface 37*a* of the sleeve cover 37 by a predetermined gap D.

Figure 6:
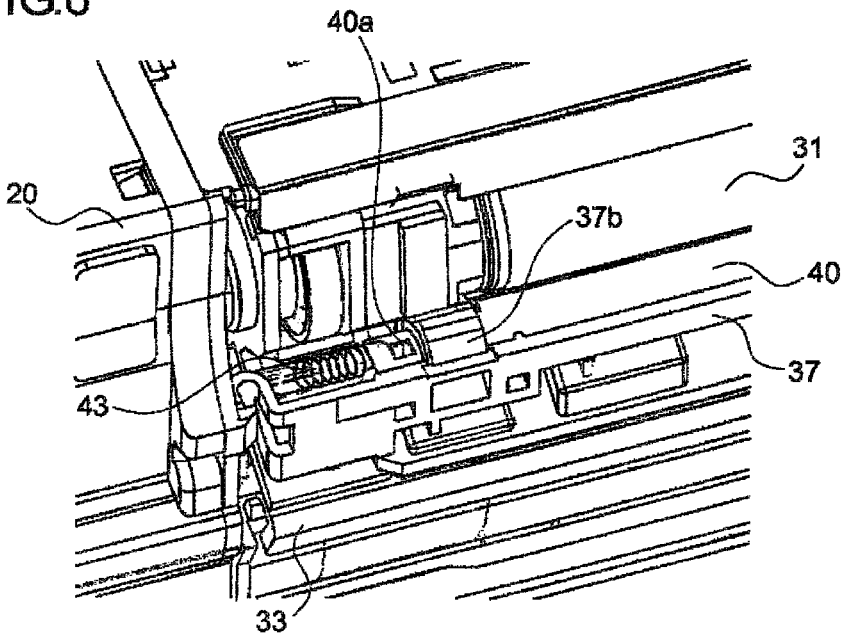
FIG. 6 is an enlarged perspective view when viewing, from a photosensitive drum 1*a*, a front side of the developing device 3*a* according to the first embodiment.
Figure 7:
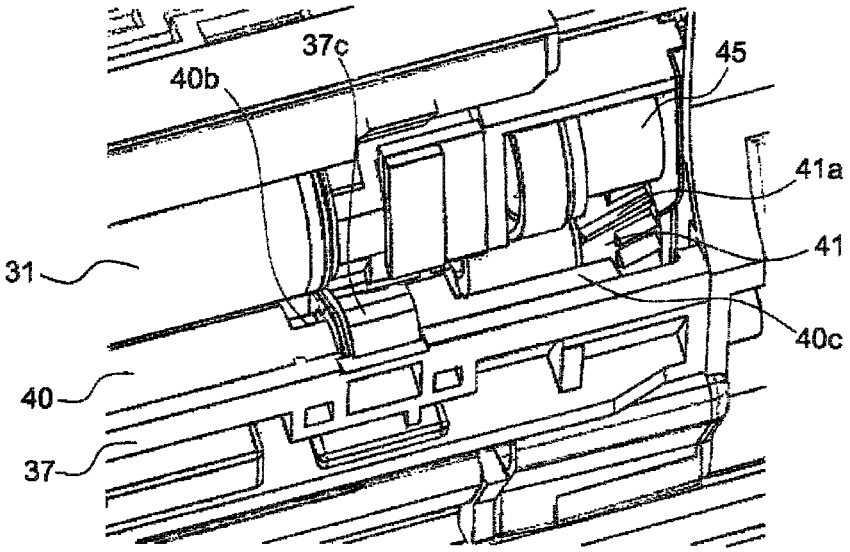
FIG. 7 is an enlarged perspective view when viewing, from the photosensitive drum 1*a*, a rear side of the developing device 3*a* according to the first embodiment.
Figure 8:
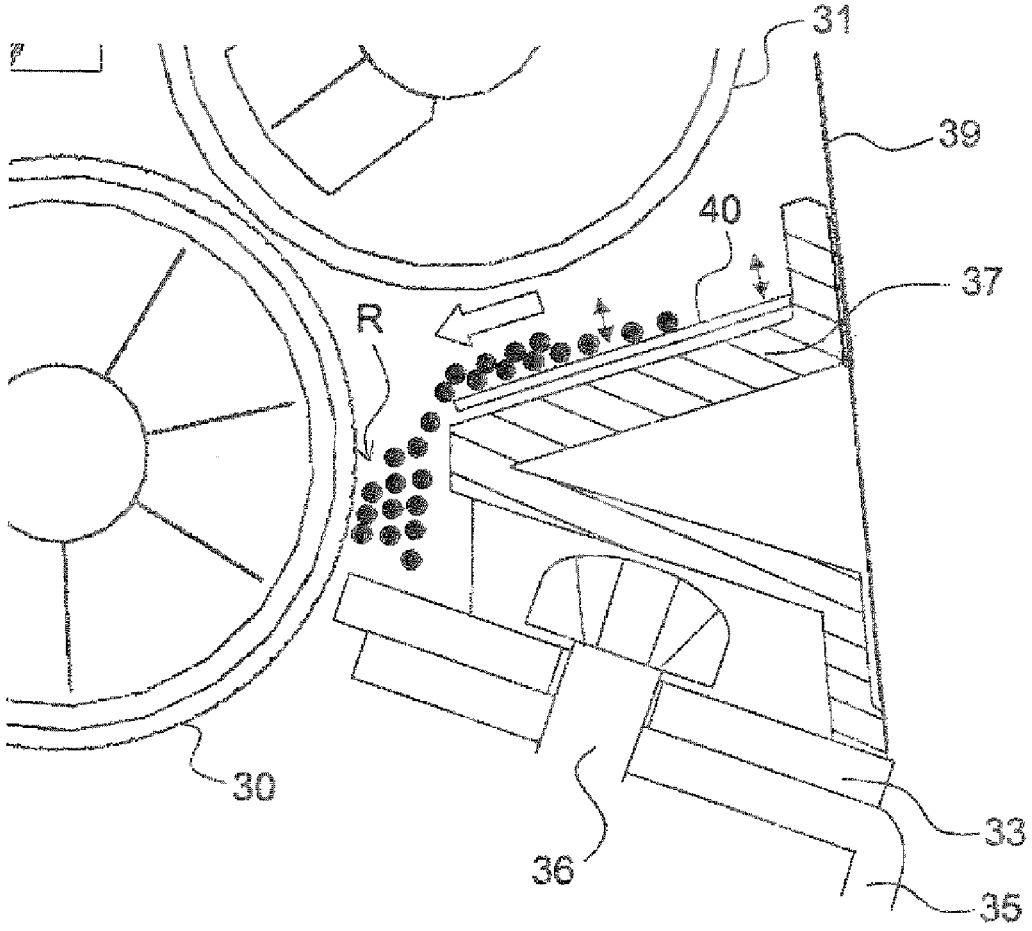
FIG. 8 is a side sectional view of a portion near the sleeve cover 37 of the developing device 3*a* according to the first embodiment.

FIG. 6 and FIG. 7 are respectively partial enlarged views of portions near the front side and rear side of the sleeve cover 37 that is disposed in the developing device 3*a*, and FIG. 8 is a partial sectional view of a portion near the sleeve cover 37 of the developing device 3*a*. Here, FIG. 6 and FIG. 7 each show a state when viewing the sleeve cover 37 from outside (right side of FIG. 3) the developing device 3*a*, and in a reverse relationship with FIG. 4 and FIG. 5 in left-right side.

As shown in FIG. 6, at the front side of the sleeve cover 37, the one end of the coil spring 34 is engaged with the engagement piece 40*a* of the film member 40, while the other end of the coil spring 43 is engaged with an engagement portion (not shown) of the sleeve cover 37. On the other hand, as shown in FIG. 7, at the rear side of the sleeve cover 37, the cutout portion 40*b* formed at the side end edge of the film member 40 is hooked on the guide portion 37*c*, whereby movement of the film member 40 in a longitudinal direction is regulated.

According to this structure, one end (front-side end portion) of the film member 40 is biased toward the front side by the coli spring 43, while the other end (rear-side end portion) of the film member 40 is regulated in movement by the engagement between the cutout portion 40*b* and the guide portion 37*c*. Accordingly, a predetermined tension is given to the film member 40 in the longitudinal direction.

Besides, a tip end portion of the protrusion piece 40*c* of the film member 40 which extends beyond the guide portion 37*c* of the rear side of the sleeve cover 37 is situated near an outer circumferential surface of the idle gear 41 which is disposed on the rear side of the developing device 3*a*. The idle gear 41 is provided with a protrusion 41*a* that is formed by extending one of the gear teeth toward the inside of the outer circumferential surface.

During the image forming time, when the toner supplying roller 30 and the developing roller 31 are driven and rotated, the idle gear 41, which transmits a drive force to the drive input gear 45 of the developing roller 31, also rotates. At this time, the protrusion 41*a* disposed on the outer circumferential surface of the idle gear 41 contacts the end edge of the protrusion piece 40*c* of the film member 40 every time the idle gear 41 makes one rotation. As a result of this, the film member 40 given the tension vibrates like a string of a stringed instrument.

As shown in FIG. 8, because of the vibration of the film member 40, the toners accumulating on the film member 40 are shaken off and leave. According to this, the toner supplying roller 30 and developing roller 31 in the developing device 3*a* rotate at a high speed, accordingly, even in a case where the toner floating amount in the developer vessel 20 is large, it is possible to alleviate the toner accumulation on the upper surface 37*a* of the sleeve cover 37. The toners shaken off the film member 40 fall into a region R sandwiched by the sleeve cover 37 and the toner supplying roller 30.

According to this, without relying on the linear velocity of the toner supplying roller 30 and the developing roller 31, it is possible to effectively alleviate image defects such as toner dropping and the like which are caused by that the toners accumulating on the upper surface 37*a* of the sleeve cover 37 aggregate into a block (blocking) which adheres to the toner supplying roller 30 or the developing roller 31.

Besides, the toner accumulation is prevented by vibrating the film member 40, accordingly, it is unnecessary to additionally dispose toner removal members such as a brush member and the like for removing the toners on the sleeve cover 37, whereby a compact and space saving structure is obtained. Besides, there is no risk that foreign mater caused by a toner removal member would circulate together with the developer in the developer vessel 20. Accordingly, it is possible to effectively prevent foreign matter from being jammed in the gap between the bristle cut blade 33 and the toner supplying roller 30 and causing image defects such as a void image and the like.

Further, the film member 40 is vibrated by using the rotation of the idle gear 41 that invariably rotates during the image forming time, accordingly, it is unnecessary to additionally dispose a dedicated motor, an actuator and the like for giving the vibration to the film member 40 and it is also possible to simplify the internal structure of the developing device 3*a*.

Here, to return the toners falling into the region R back into the supply-convey chamber 22, it is preferable to rotate the toner supplying roller 30 during a time of not-forming an image in a direction reverse (clockwise direction in FIG. 8) to the direction during the image forming time. By rotating the toner supplying roller 30 in the reverse direction, the toners, falling into the region R and temporarily accumulating near the tip end portion of the bristle cut blade 33, are collected by the magnetic brush formed on the surface of the toner supplying roller 30, rotated by the toner supplying roller 30 to pass through the gap between the toner supplying roller 30 and the bristle cut blade 33. And, the toners are peeled off the toner supplying roller 30 by the same polarity portion of the stationary magnet body and forcibly returned into the supply-convey chamber 22 (see FIG. 3).

Figure 9:
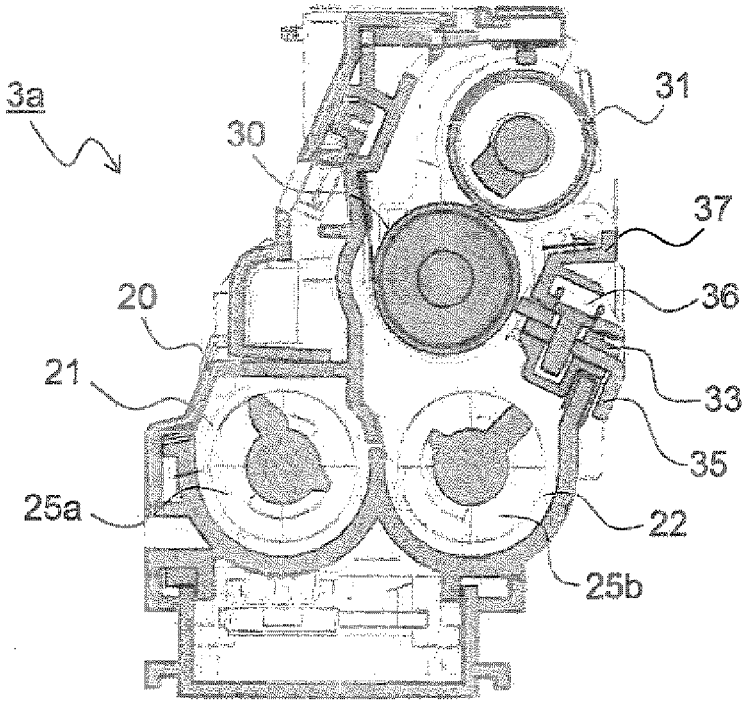
FIG. 9 is a side sectional view of the developing device 3*a* according to a second embodiment of the present disclosure.
Figure 10:
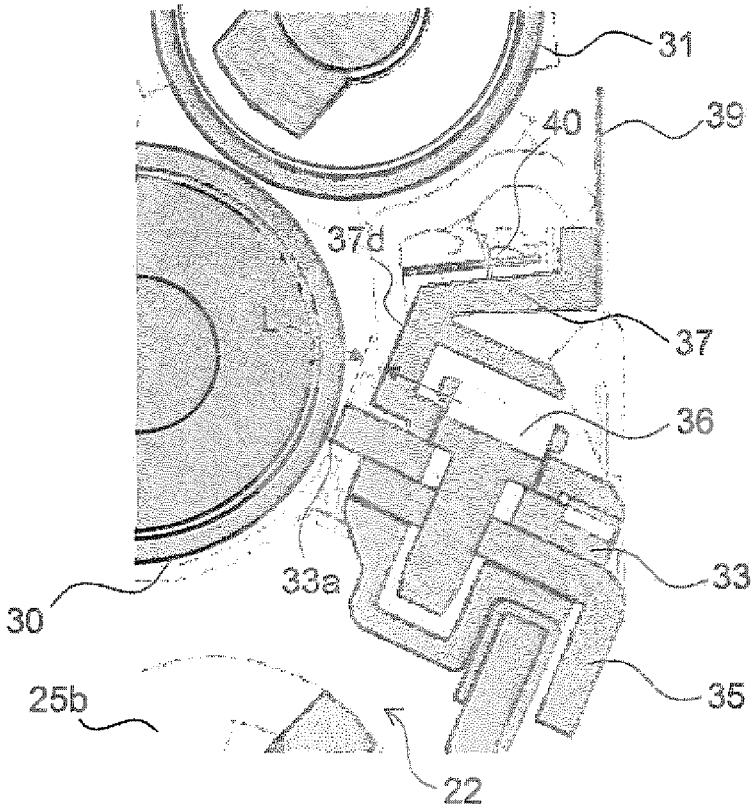
FIG. 10 is a partial enlarged view of a peripheral portion of a bristle cut blade 33 in FIG. 9.

FIG. 9 is a side sectional view of the developing device 3*a* according to a second embodiment of the present disclosure, and FIG. 10 is a partial enlarged view of a peripheral portion of the bristle cut blade 33 in FIG. 9. In the present embodiment, a positioning mechanism that positions the sleeve cover 37 with respect to the bristle cut blade 33 is disposed, and a distance L between an opposing surface 37*d* of the sleeve cover 37 that opposes the toner supplying roller 30 and an edge portion 33*a* of the bristle cut blade 33 can be kept constant. The structure of the other portions of the developing device 3*a* and the mechanism for vibrating the film member 40 are the same as the first embodiment, accordingly, description of them is skipped.

When collecting the toners that fall on the bristle cut blade 33 from the film member 40, the distance L is extremely important. If the distance L is too long, the magnetic brush does not reach the toners accumulating on a portion of the bristle cut blade 33 near the opposing surface 37*d*, and it becomes impossible to sufficiently collect the toners. On the other hand, if the distance L is too short, the toners fall directly onto the toner supplying roller 30 from the film member 40 during the image forming and a toner dropped image occurs.

To avoid this, in the present embodiment, by disposing the positioning mechanism that positions the sleeve cover 37 with respect to the bristle cut blade 33, it is always possible to keep the distance L constant and effectively alleviate the defective collection of the toners accumulating on the bristle cut blade 33 and the occurrence of a toner dropped image.

Figure 11:
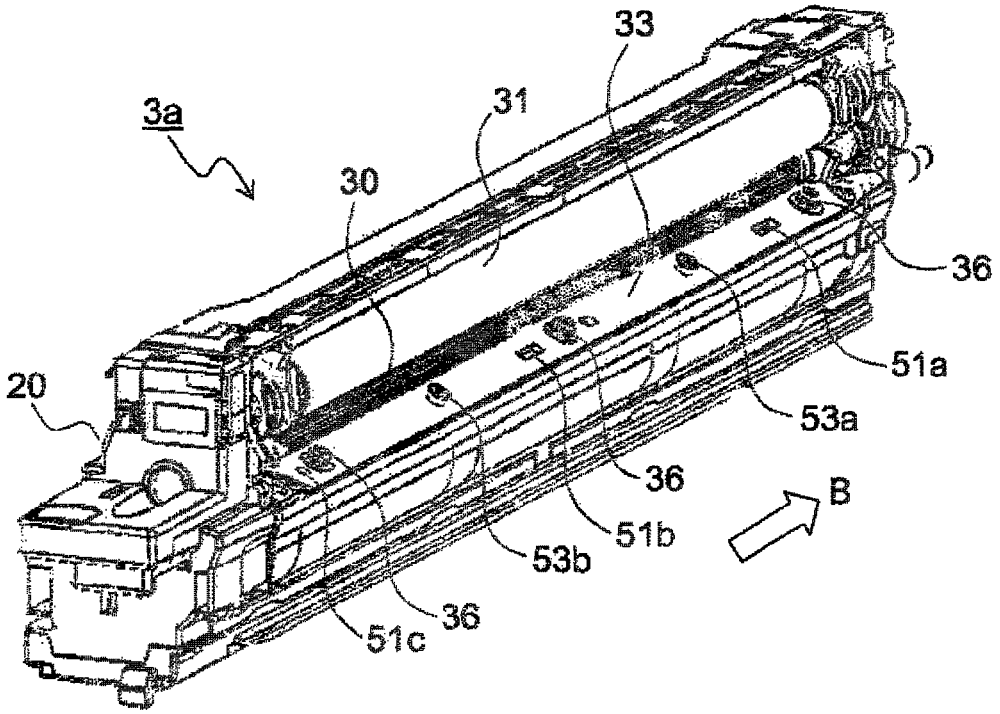
FIG. 11 is a perspective view showing a state where the sleeve cover 37 is removed from the developing device 3*a* according to the second embodiment.

Next, the positioning mechanism of the sleeve cover 37 in the present embodiment is specifically described. FIG. 11 is a perspective view showing a state where the sleeve cover 37 is removed from the developing device 3*a* according to the present embodiment to expose the bristle cut blade 33, and FIG. 12 is a perspective view when viewing the sleeve cover 37 used in the developing device 3*a* according to the present embodiment from a rear surface (contact surface with the bristle cut blade 33).

As shown in FIG. 11, the bristle cut blade 33 is fastened and secured, by the blade fastener screw 36, to the blade support stay 35 disposed on the developer vessel 20. Besides, the upper surface of the bristle cut blade 33 is provided with two first positioning holes 51*a*, 51*b* and one second positioning hole 51*c*. The first positioning holes 51*a*, 51*b* are long holes along a longitudinal direction of the bristle cut blade 33, and the second positioning hole 51*c* is a round hole that has the same shape as a second positioning boss 55*c* (see FIG. 12). The upper surface of the bristle cut blade 33 is provided with positioning pins 53*a*, 53*b* at two positions.

Figure 12:
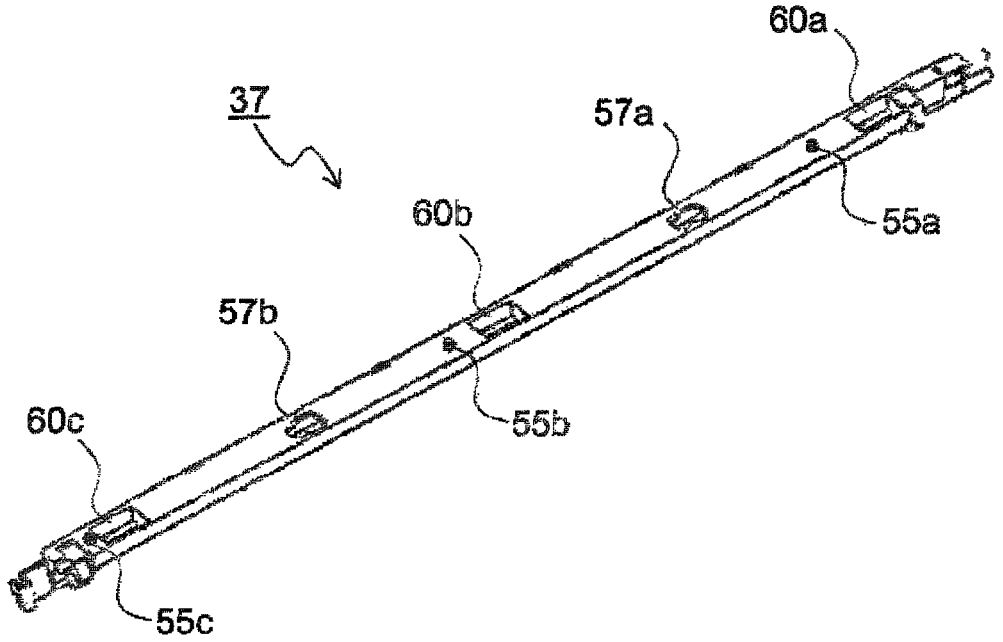
FIG. 12 is a perspective view when viewing, from a surface contacting the bristle cut blade 33, the sleeve cover 37 used in the developing device 3*a* according to the second embodiment.

As shown in FIG. 12, on the rear surface of the sleeve cover 37, first positioning bosses 55*a*, 55*b* for engaging with the first positioning holes 51*a*, 51*b* (see FIG. 11) of the bristle cut blade 33 and the second positioning boss 55*c* for engaging with the second positioning hole 51*c* (see FIG. 11) are disposed to protrude. Besides, the rear surface of the sleeve cover 37 is provided with two pin holes 57*a*, 57*b* for engaging with the positioning pins 53*a*, 53*b* (see FIG. 11) of the bristle cut blade 33 and three escape holes 60*a* to 60*c* for avoiding interference of the blade fastener screw 36 and the sleeve cover 37.

Figure 13:
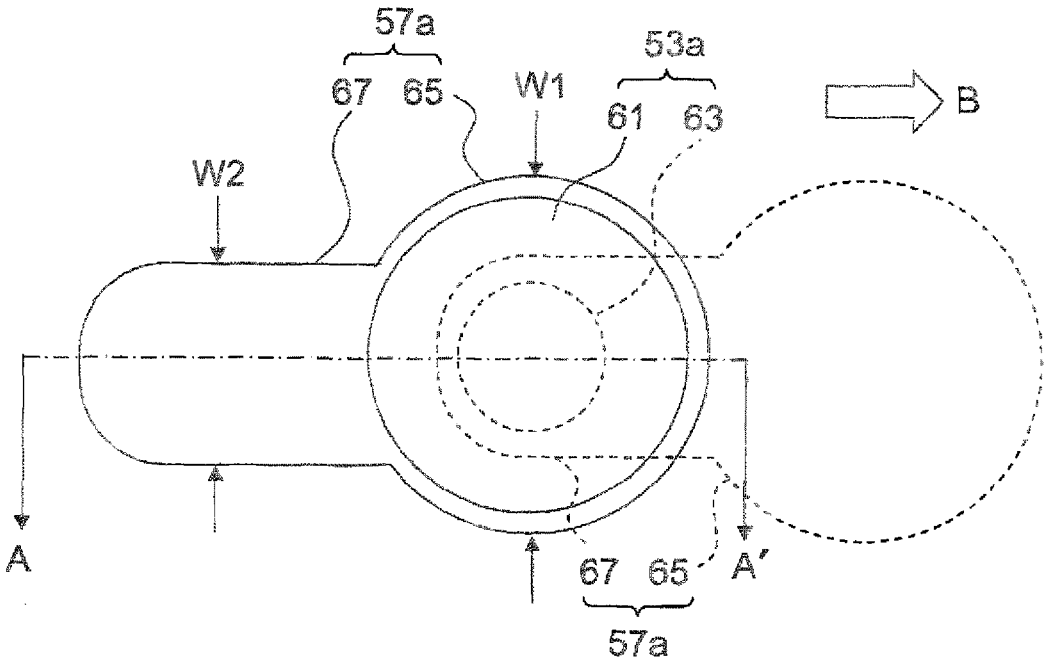
FIG. 13 is a plan view showing a state where a positioning pin 53*a* engages with a pin hole 57*a* in the developing device 3*a* according to the second embodiment.
Figure 14:
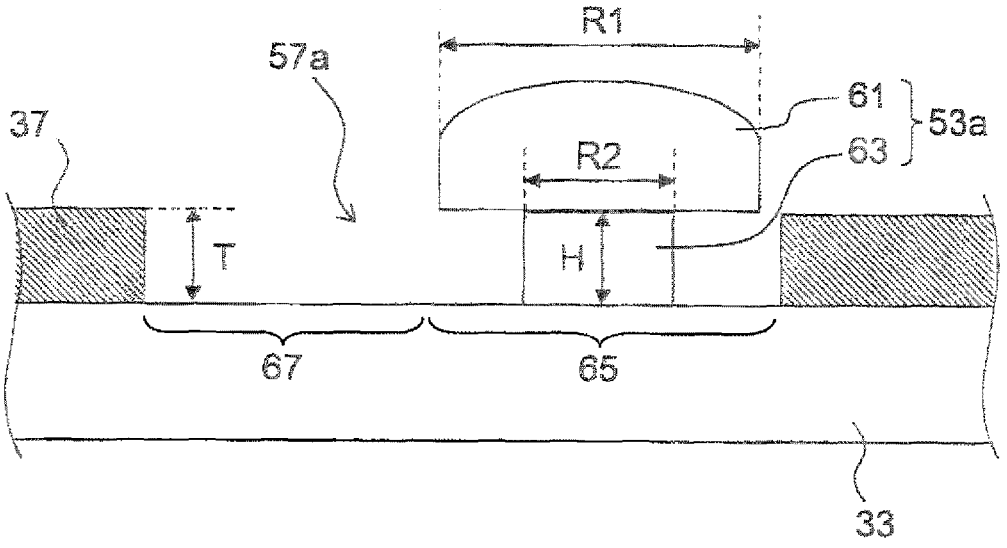
FIG. 14 is a sectional view showing a state where the positioning pin 53*a* engages with the pin hole 57*a* in the developing device 3*a* according to the second embodiment

FIG. 13 is a plan view showing a state where the positioning pin 53*a* engages with the pin hole 57*a*, and FIG. 14 is a sectional view (view taken in a direction of an A-A' arrow in FIG. 13) showing a state where the positioning pin 53*a* engages with the pin hole 57*a*. Hereinafter, a relationship between the positioning pin 53*a* and the pin hole 57*a* is described, and a relationship between the positioning pin 53*b* (see FIG. 11) and the pin hole 57*b* (see FIG. 12) is also described in the completely same way.

The positioning pin 53*a* is composed of a head portion 61 and a shank portion 63 that is smaller than the head portion 61 in diameter. The pin hole 57*a* is formed of a circle-shaped engagement hole 65 and a long hole-shaped guide hole 67 communicating with the engagement hole 65, and is formed into a key hole shape when viewing from top. An inner diameter W1 of the engagement hole 65 is formed to be larger than a diameter R1 of the head portion 61 of the positioning pin 53*a*. A width W2 of the guide hole 67 is formed to be smaller than the diameter R1 of the head portion 61 and larger than a diameter R2 of the shank portion 63. Besides, a height H of the shank portion 63 is slightly higher than a thickness T of the rear surface of the sleeve cover 37.

Next, with reference to FIG. 9 to FIG. 14, a method for mounting the sleeve cover 37 is described. First, the sleeve cover 37 is applied to the upper surface of the bristle cut blade 33 such that the engagement holes 65 of the pin holes 57*a*, 57*b* formed in the rear surface of the sleeve cover 37 engage with the positioning pins 53*a*, 53*b* formed on the upper surface of the bristle cut blade 33. At this time, the rear surface of the sleeve cover 37 is provided with the escape holes 60*a* to 60*c* at the positions that oppose the three blade fastener screws 36, accordingly, the rear surface of the sleeve cover 37 and the upper surface of the bristle cut blade 33 come into tight contact with each other.

The first positioning bosses 55*a*, 55*b* formed on the rear surface of the sleeve cover 37 each engage with one end (left end of FIG. 11) of the first positioning holes Ma, 51*b* formed on the upper surface of the bristle cut blade 33. Because of the engagement of the first positioning boss 55*a* and the first positioning hole Ma and the engagement of the first positioning boss 55*b* and the first positioning hole 51*b*, the sleeve cover 37 is positioned in a width direction (left-right direction of FIG. 10) with respect to the bristle cut blade 33. Here, in this state, the second positioning boss 55*c* and the second positioning hole 51*c* do not engage with each other and movement of the sleeve cover 37 in the longitudinal direction is allowed.

Next, by sliding the sleeve cover 37 in the longitudinal direction (an arrow B direction) of the bristle cut blade 33, the first positioning bosses 55*a*, 55*b* each move from one end (left end of FIG. 11) to the other end (right end of FIG. 11) of the first positioning holes 51*a*, 51*b*. Besides, the second poisoning boss 55*c* engages with the second positioning hole 51*c*, whereby the movement of the sleeve cover 37 in the longitudinal direction with respect to the bristle cut blade 33 is regulated.

Because of the slide of the sleeve cover 37, the pin holes 57*a*, 57*b* engaging with the positioning pins 53*a*, 53*b* also move in the arrow B direction (indicated by a broken line in FIG. 3). As a result of this, the engagement positions of the positioning pins 53*a*, 53*b* for the pin holes 57*a*, 57*b* move from the engagement holes 65 to the guide holes 67. As described above; the diameter R1 of the head portion 61 of the positioning pins 53*a*; 53*b* is larger than the width W2 of the guide hole 67, accordingly, the circumferential edge portion of the guide hole 67 is sandwiched between the upper surface of the bristle cut blade 33 and the head portion 61, whereby movement of the sleeve cover 37 in a vertical direction with respect to the bristle cut blade 33 is regulated.

According to the above structure, the sleeve cover 37 is positioned in the longitudinal direction, the width direction and the vertical direction with respect to the bristle cut blade 33, accordingly, the distance L between the opposing surface 37*d* of the sleeve cover 37 opposing the toner supplying roller 30 and the edge portion 33*a* of the bristle cut blade 33 becomes keepable constant. Besides, it is possible to secure the sleeve cover 37 to the bristle cut blade 33 without using a securing member such as a screw and the like, accordingly, it is possible to reduce the number of members and the mounting workability of the sleeve cover 37 also improves.

Here, by sliding the sleeve cover 37 in a width direction (left-right direction of FIG. 10) of the bristle cut blade 33, it is possible to engage: the positioning pins 53*a*, 53*b* with the pin holes 57*a*, 57*b*; the first positioning bosses 55*a*, 55*b* with the first positioning holes 51*a*, 51*b*; and the second positioning boss 55*c* with the second positioning hole 51*c*. However, to slide the sleeve cover 37 in the width direction, it becomes necessary to form the escape holes 60*a* to 60*b* for the fastener screws 36 in the opposing surface 37*d* of the sleeve cover 37. As a result of this, it is impossible to form the opposing surface 37*d* to be a flat surface and the distance L between the opposing surface 37*d* and the edge portion 33*a* does not become constant in the longitudinal direction of the sleeve cover 37, accordingly, there is a risk that the toners accumulating near the edge portion 33*a* of the bristle cut blade 33 could not be evenly collected.

Besides, according to a structure in which the escape holes 60*a* to 60*c* are engaged with the fastener screws 36 as if covering the fastener screws 36, the sleeve cover 37 is slidable in the width direction with the opposing surface 37*d* formed to be a flat surface. However, in this case, a blade width of the bristle cut blade 33 for sliding the sleeve cover 37 in the width direction becomes necessary and the developing device 3*a* becomes large to secure the blade width, which is accordingly not preferable from the viewpoint of size reduction and compactness of the developing device 3*a*. Accordingly, as in the present embodiment, the structure is preferable, in which the guide hole 67 and the first positioning holes 51*a*, 51*b* are formed in parallel with the longitudinal direction of the sleeve cover 37 and the bristle cut blade 33; and the sleeve cover 37 is slid in the longitudinal direction of the bristle cut blade 33 to perform the positioning.

Besides, the present disclosure is not limited to each of the above embodiments, and it is possible to add various modifications without departing from the spirit of the present disclosure. For example, the structure and shape of the sleeve cover 37 and film member 40 described in each of the above embodiments are examples, not limited to each of the above embodiments and it is possible to suitably set the structure and shape in accordance with the structure and the like of the developing device 3*a*.

For example, in each of the above embodiments, the one end of the film member 40 is provided with the engagement hole 40*a* to which the coil spring 43 is connected and the other end is provided with the cutout portion 40*b* that engages with the guide portion 37*c*, however, both ends of the film member 40 may be provided with the engagement hole 40*a* and the coil spring 43 may be connected to each engagement hole 40*a*. Besides, in each of the above embodiments, the structure is employed, in which the protrusion piece 40*c* of the film member is vibrated by using the protrusion 41*a* disposed on the idle gear 41, however, it is also possible to vibrate the protrusion piece 40*c* of the film member by using another gear that composes the group of gears of the toner supplying roller 30 or developing roller 31.

Figure 15:
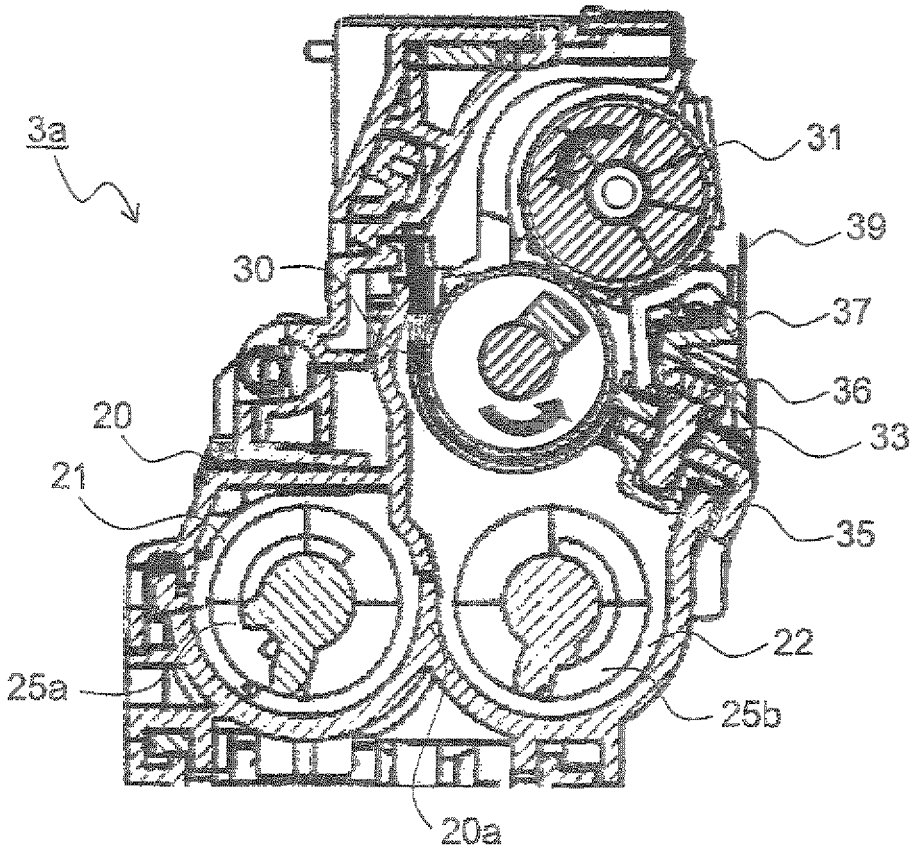
FIG. 15 is a side sectional view showing the developing device 3*a* according to the present invention with a structure of a toner supplying roller 30 and a structure of a developing roller 31 replaced with each other in FIG. 3.

Besides, in each of the above embodiment, the present disclosure is applied to the developing devices 3*a* to 3*d* in which the two-component developer is used; the magnetic brush is formed on the toner supplying roller 30; only the toners are moved from the toner supplying roller 30 to the developing roller 31; and the toners are supplied from the developing roller 31 to the photosensitive drums 1*a* to 1*d*, however, besides, as shown in FIG. 15, the present disclosure is also applicable to a developing device in which the dispositions of the developing roller 31 and toner supplying roller 30 are reversed from each of the above embodiments; toners are supplied to the photosensitive drums 1*a* to 1*d* by using a magnetic brush composed of the two-component developer that is carried on the surface of the developing roller 31 (which, in the present structure, becomes a magnetic roller that has the same structure as the toner supplying roller 30 in each of the above embodiments.); the toners carried on the surface of the toner supplying roller 30 (which, in the present structure, has the same structure as the developing roller 31 in each of the above embodiments.) are supplied to the developing roller 31; and the remaining toners on the surface of the developing roller 31 are collected by using the toner supplying roller 30. In this structure as well, it is possible to effectively alleviate the toners that fall from the developing roller 31 accumulating on around the regulation blade 33 that opposes the toner supplying roller 30.

Besides, in each of the above embodiments, the color printer 100 of tandem type is described as an example, however, it goes without saying that the present disclosure is applicable to other devices, for example, such as monochrome and color copy machines, a digital multi-function machine, a monochrome printer, a facsimile and the like.

The present disclosure is usable in a developing device that has an inner wall portion which opposes a developing roller between a blade and an image carrier in a casing. By using the present disclosure, it is possible to effectively alleviate the toner accumulation at the inner wall portion of the developing device. Besides, by disposing the above developing device, an image forming apparatus is obtained, which is able to prevent image defects such as toner dropping and the like caused by the toner accumulation.

What is claimed is:

1. A developing device comprising:

a developing roller that is disposed to oppose an image carrier on which an electrostatic latent image is formed and supplies a developer to the image carrier at a region that opposes the image carrier;

a toner supplying roller that is disposed to oppose the developing roller and supplies a toner to the developing roller at a region that opposes the developing roller;

a regulation blade that is disposed to oppose the toner supplying roller over a predetermined gap;

a casing that houses the developing roller, the toner supplying roller and the regulation blade and includes an inner wall portion which opposes the developing roller between the regulation blade and the image carrier;

a film member that is formed of a flexible material, disposed away from an upper surface of the inner wall portion by a predetermined gap and vibratile in a direction to approach or leave the inner wall portion;

a bias member that is connected to at least one end in a longitudinal direction of the film member and gives tension to the film member; and a protrusion that is disposed on a gear composing a group of drive gears of the developing roller or the toner supplying roller and intermittently contacts an end edge of the film member because of rotation of the gear to vibrate the film member.

2. The developing device according to claim 1, wherein during a time of not-forming an image, the toner supplying roller is rotated in a direction reverse to a direction during a time of forming an image.

3. The developing device according to claim 2, wherein the inner wall portion is composed of a sleeve cover mounted on the casing and is provided with a positioning mechanism which positions the sleeve cover with respect to the regulation blade such that a distance between an upper surface of the sleeve cover that is a surface of the inner wall portion which opposes the toner supplying roller and a tip end portion of the regulation blade becomes constant.

4. The developing device according to claim 3, wherein the positioning mechanism includes: a plurality of positioning pins each of which has a shank portion that is formed on an upper surface of the regulation blade to protrude and a head portion that is formed on a tip end of the shank portion and has a diameter larger than the shank portion; a plurality of pin holes each of which is composed of an engagement hole that is formed in a contact surface of the sleeve cover, contacts the upper surface of the regulation blade, and has an inner diameter larger than the diameter of the head portion; and a long hole-shaped guide hole which communicates with the engagement hole, has a width that is smaller than the diameter of the head portion and larger than the diameter of the shank portion; wherein the positioning pin is engaged with the engagement hole and the sleeve cover is slid until a position where the positioning pin engages with the guide hole, whereby movement of the sleeve cover in a vertical direction with respect to the regulation blade is regulated.

5. The developing device according to claim 4, wherein the guide hole extends substantially in parallel with a longitudinal direction of the sleeve cover.

6. The developing device according to claim 5, wherein the positioning mechanism includes: a first positioning boss that is formed on the contact surface of the sleeve cover which contacts the regulation blade; and a first positioning hole which is formed, on the upper surface of the regulation blade corresponding to the first positioning boss, into a long hole shape parallel with the guide hole; wherein the first positioning boss engages with the first engagement hole, whereby movement of the sleeve cover in the longitudinal direction with respect to the regulation blade is allowed and movement of the sleeve cover in a width direction is regulated.

7. The developing device according to claim 6, wherein the positioning mechanism includes: a second positioning boss that is formed on the contact surface of the sleeve cover which contacts the regulation blade; and a second positioning hole which is formed, on the upper surface of the regulation blade corresponding to the second positioning boss, into a same shape as the second positioning boss; wherein when the sleeve cover is slid until the position where the positioning pin engages with the guide hole, the second positioning boss engages with the second engagement hole, whereby the movements of the sleeve cover in the width direction and in the longitudinal direction are regulated with respect to the regulation blade.

8. The developing device according to claim 1, wherein the film member is formed of a material which has a toner attraction force weaker than the inner wall portion.

9. The developing device according to claim 1, wherein the toner supplying roller is a magnetic roller that carries a two-component developer containing a toner and a carrier by using a plurality of magnetic poles which are disposed inside.

10. The developing device according to claim 1, wherein the developing roller is a magnetic roller that carries a two-component developer containing a toner and a carrier by using a plurality of magnetic poles which are disposed inside.

11. An image forming apparatus comprising the developing device according to claim 1.

* * * * *